US005806313A

United States Patent [19]

Koshi et al.

[11] Patent Number: 5,806,313

[45] Date of Patent: Sep. 15, 1998

[54] CONDUIT ARRANGEMENT FOR A CONSTRUCTION MACHINE

[75] Inventors: Howard T. Koshi, Redmond, Wash.; Thomas C. Grieshaber, Waterville, Kans.

[73] Assignee: Caterpillar Inc., Peoria, Ill.

[21] Appl. No.: 758,613

[22] Filed: Nov. 27, 1996

Related U.S. Application Data

[60] Provisional application No. 60/007,809, Nov. 30, 1995.

[51] Int. Cl.[6] ..... B66C 23/00; E02F 3/85

[52] U.S. Cl. ..... 60/458; 414/722; 414/918

[58] Field of Search ..... 60/458; 138/106; 248/68.1; 52/115; 414/722, 918, 694

[56] References Cited

U.S. PATENT DOCUMENTS

| | | | |
|---|---|---|---|
| 2,961,106 | 11/1960 | Davis | 414/694 |
| 3,214,033 | 10/1965 | Nilsson | 414/918 |
| 4,193,734 | 3/1980 | Williams | 414/694 |
| 4,265,063 | 5/1981 | Muller | 52/115 |
| 4,304,077 | 12/1981 | Muller | 52/115 |
| 4,495,766 | 1/1985 | Krusche | 60/428 |
| 5,176,491 | 1/1993 | Houkom | 414/918 |
| 5,181,591 | 1/1993 | Zona et al. | 414/918 |
| 5,232,330 | 8/1993 | Rae et al. | 414/918 |

FOREIGN PATENT DOCUMENTS

7/56364 12/1995 Japan .

*Primary Examiner*—Sheldon Richter
*Attorney, Agent, or Firm*—William C. Perry

[57] ABSTRACT

This invention relates to an arrangement for communicating fluid between a pressurized source and an implement that is remotely mounted on a linkage arrangement of a construction machine. The conduit arrangement includes a pair of conduits positioned internally within the linkage arrangement. One conduit communicates the pressurized fluid to a control valve mounted on the end of the linkage, while the second returns the fluid to a reservoir. This arrangement permits a plurality of conduits to extend between the control valve and a multi-function implement mounted on the linkage arrangement while limiting the number of conduits between the control valve and the source of pressurized fluid.

18 Claims, 2 Drawing Sheets

CONDUIT ARRANGEMENT FOR A CONSTRUCTION MACHINE

CROSS REFERENCE TO RELATED APPLICATIONS

This application is based, in part, on the material disclosed in the U.S. provisional patent application Ser. No. 60/007809, filed Nov. 30, 1995.

TECHNICAL FIELD

This invention relates to the communication of hydraulic fluid from a machine to a remotely mounted work implement and more particularly to an arrangement for routing the hydraulic conduits within the structure that mounts the work implement to the machine.

BACKGROUND ART

In the operation of construction machinery, it is quite common to utilize an implement that requires the use of pressurized fluid for operation. On hydraulic excavators for example, a variety of implements such as a grapple, a hammer or a feller/buncher is designed for use on the machine. These implements are mounted on the end of a linkage arrangement that may be manipulated to position the implement in the desired fashion to perform the required work. Pressurized fluid must be delivered from an engine driven pump mounted on the machine frame, along the linkage arrangement to the implement. Some implements, such as the feller/buncher, utilize multiple functions and require the routing of a plurality of hoses or conduits to the implement, usually at least two lines per function.

A common method of delivering the fluid from the main machine frame to the implement requires the mounting of the fluid conduits directly to the upper side of the boom and stick members that comprise the linkage assembly. The various conduits are secured by a series of brackets, such as pillow blocks, that are spaced at regular intervals along both the boom and the stick members. Flexible hoses are utilized to bridge the junction between the boom and stick members to accommodate for relative movement therebetween. Flexible hoses are also utilized between the stick and the implement for the same reasons. This has been known to work quite well in most instances. One problem that arises with this design occurs when the implement is to be used in a rugged environment, which is normally the case when the implement is a feller/buncher. A feller/buncher is typically used in a forest where contact between the linkage arrangement and limbs from surrounding trees is inevitable. To prevent damage to the conduits mounted on the upper surfaces, of the boom and the stick members, extensive guarding must be provided to cover the conduits and associated mounting apparatus. This not only adds to the cost and complexity of the linkage arrangement, it also adds weight to the linkage arrangement that ultimately could limit the performance of the machine.

Another problem that is encountered with the use of the feller/buncher, is the multiple hydraulic functions utilized in its operations. A typical feller/buncher may have a pair of grapples that are actuated by at least one hydraulic cylinder per grapple and a shear or a saw that also requires hydraulic fluid for operation. Some feller/bunchers include delimbing capabilities that are also hydraulically operated. Since each function typically requires a conduit to deliver pressurized fluid and one to return the fluid to a reservoir, the number of lines that must run between the machine frame and the feller/buncher is quite numerous. This also adds greatly to the expense and complexity of the application.

The present invention is directed to overcoming one or more of the problems set forth above.

DISCLOSURE OF THE INVENTION

In one aspect of the present invention a conduit arrangement is provided for communicating pressurized fluid between a machine frame and a work implement remotely mounted to the frame. The conduit arrangement includes a boom assembly having first and second end portions. The first end portion is pivotally connected to the machine frame and the second end portion is mounted to the work implement. A first fluid coupling member is connected to the first end portion of the boom assembly and a second fluid coupling member is connected to the second end portion of the boom assembly. An internal conduit assembly defines a duct that is secured within the boom assembly between the end portions thereof and at least one fluid conduit is positioned within the duct. The fluid conduit has a first end portion connected to an internal portion of the first fluid coupling member and a second end portion connected to an internal portion of the second fluid coupling member. A first external conduit has a first end portion connected to a source of pressurized fluid and a second end portion connected to an external portion of the first coupling. A second external conduit has a first end portion connected to an external portion of the second coupling and a second end portion connected to the implement for delivery of the pressurized fluid thereto.

In another aspect of the present invention a conduit arrangement is provided for communicating pressurized fluid from a machine frame to an implement mounted to the frame by a boom assembly. The boom assembly includes a first boom member having first and second end portions, the first end portion of which being connected to the machine frame. A second boom member is included that has a first end portion connected to the second end portion of the first boom member and a second end portion connected to the work implement. A control valve is mounted on the second end portion of the second boom assembly. An internal conduit assembly having a duct defined therein is secured internally within each of the boom members. A first fluid conduit means is positioned to extend between a source of pressurized fluid located on the machine frame and the control valve. The first fluid conduit means is positioned substantially within the internal conduit assemblies of the first and second boom members. A second fluid conduit means is positioned to extend between a fluid reservoir located on the machine frame and the control valve. The second fluid conduit means is also positioned substantially within the internal conduit assemblies of the first and second boom members. A plurality of conduits are positioned to extend between the control valve and the work implement and are located exteriorly of the second boom member.

With a conduit arrangement as set forth above, the routing of the fluid conduit within the boom assembly provides protection of the conduit from damage when the machine is required to operate in a rugged environment. Also, since the control valve is mounted on the boom assembly at a location that is in close proximity to the implement, the number of conduits routed between the machine and the control valve is reduced basically to a pressure and a return line. The more numerous lines required for each particular implement function need only extend between the control valve and the implement thus greatly reducing their length and making their routing much more simple. This is especially valuable when the work implement is provided with a plurality of functions.

BEST MODE FOR CARRYING OUT THE INVENTION

Figure 1:
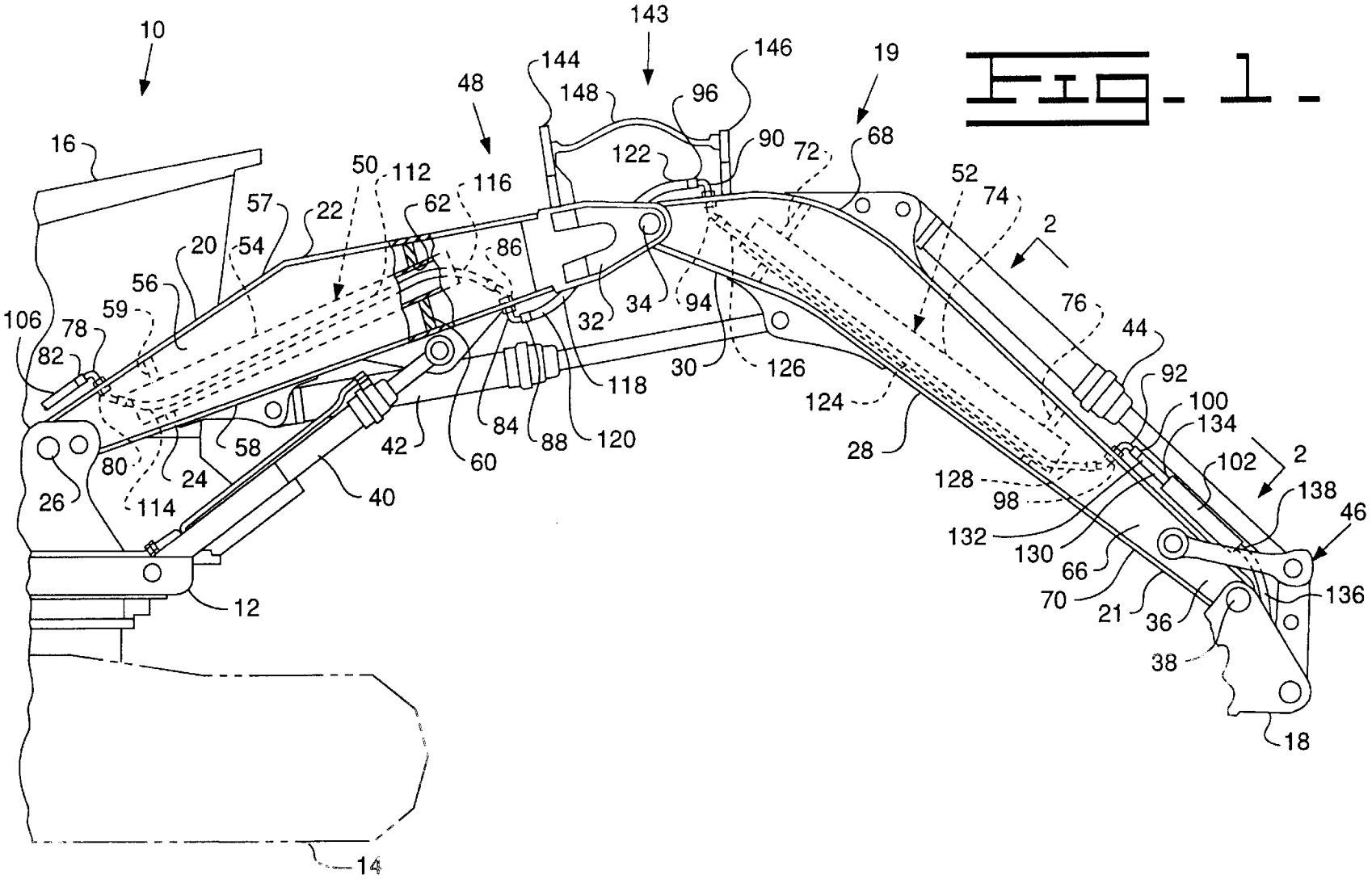
FIG. 1 is a diagrammatic side view of a construction machine that embodies the principles of the present invention.

Referring now to the drawings, it can be seen that a construction machine 10 is shown, which in this particular instance is a hydraulic excavator. The excavator has a main frame 12 that supports a track assembly 14 and an engine (not shown) that provides power to the track assembly to move the machine from one place to another. An operator station 16 is also mounted on the main frame 12 and provides a location from which the machine may be controlled.

One of the control functions of the machine includes the operation of a work implement 18. The work implement may take the form of one of a variety of implements that includes but is not limited to a bucket, a hammer, a saw or a feller/buncher. The work implement 18 is mounted to the machine frame 12 by a linkage arrangement 19 which has a first end portion 20 mounted to the machine frame and a second end portion 21 mounted to the work implement. In the illustrated embodiment the linkage arrangement 19 is shown to be a boom assembly. The boom assembly includes a first boom member 22 that has a first end portion 24 that is pivotally mounted to the machine frame 12 by a mounting pin 26. A second boom member, or stick member 28, as shown in the illustrated embodiment, has a first end portion 30 pivotally mounted to a second end portion 32 of the boom 22 by a connecting pin 34 and a second end portion 36 that is pivotally mounted to the work implement 18 by connecting pin 38. The boom 22 is moved about pin 26 in a substantially vertical plane with respect to the machine 10 by a hydraulic lift cylinder 40. Likewise, the stick 28 is pivoted about pin 34 with respect to the boom by a hydraulic stick cylinder 42 in the same plane of movement as that of the boom. The work implement is pivoted about pin 38 by a tilt cylinder 44 and an associated tilt linkage arrangement 46, also in the same vertical plane as the stick and boom. The controls for the linkage arrangement 19 are located in the operator station 16 and are operated in a coordinated manner, depending upon what implement is being utilized in a well known manner.

The work implement 18 often includes a function that requires the provision of pressurized fluid for operation. In the illustrated embodiment, the fluid is communicated to the work implement from a source of pressurized fluid, such as an engine driven pump (not shown) by a conduit arrangement generally indicated by the reference numeral 48. The conduit arrangement includes a pair of internal conduit assemblies 50 and 52 that are positioned within the confines of the boom member 22 and the stick 28 respectively.

The internal conduit assembly 50 defines a tubular duct 54 that is integrally formed within the boom 22. The boom 22 is defined by a pair of identical side plates 56 (one shown) that are laterally spaced from one another. An upper and lower plate 57 and 58 respectively are attached to the side plates, as by welding for example, to form a box section. A plurality of internal braces are positioned within the boom along the length thereof to provide additional structural rigidity. A rear brace 59 is provided with a bore (not shown) that receives the tubular duct and secures the duct 54 to the first end portion 30 of the stick 28. Likewise, a front brace 60 is provided with a bore 62 that receives the duct 54 and secures the duct to the second end portion 32 of the boom 28.

The internal Conduit assembly 52 is constructed in a similar fashion as the internal conduit assembly 50 and is integrally formed within the stick member 28. The stick member is formed of a box section having a pair of identical side plates 66 that are connected on their upper and lower extremities by plates 68 and 70 respectfully. A plurality of internal braces extend between the plates of the box section along the length of the stick to provide structural rigidity. A rear brace 72 defines a bore that receives a tubular duct 74 in a similar fashion to that shown with respect to the brace 60 of the boom member. Likewise a front brace 76 supports the opposite end of the tubular duct 74 near the second end portion 36 of the stick 28.

The boom member 22 is provided with a plurality of coupling members on opposing end portions thereof. At least two first fluid coupling members (one shown) 78 are mounted laterally adjacent one another to the upper plate 57 of the boom member 22 in the region of the first end portion 24 of the boom. Each of the first fluid coupling members define an internal connecting portion, or stem, 80 that extends into the box section of the boom member and an external connecting portion, or stem, 82 that is positioned outside the box section. At least a pair of second fluid coupling members 84 is mounted to the lower plate 58 of the boom member 22 in laterally adjacent relation to one another in the region of the second end portion 36 of the boom. Each of the second fluid coupling members 84 define an internal connecting portion, or stem, 86 that extends into the box section and an external connecting portion, or stem, 88 that is positioned outside the box section.

Like the boom member 22, the stick member 28 is provided with a plurality of coupling members on its opposing end portions. At least a pair of third fluid coupling members 90 (one shown) is mounted to the upper plate 68 of the stick in laterally adjacent relation to one another in the region of the first end portion 30 of the stick. Each of the third fluid coupling members 90 defines an internal connecting portion, or stem, 94 that extends into the box section and an external connecting portion, or stem, 96 that is positioned outside the box section. At least a pair of fourth fluid coupling members 92 are mounted to the upper plate 68 of the stick member in laterally adjacent relation to one another in the region of the second end portion 36 of the stick. Each of the fourth fluid coupling members defines an internal connecting portion, or stem, 98 that extends into the box section and an external connecting portion, or stem, 100 that is positioned outside the box section.

A control valve 102 is secured to the upper plate 68 of the stick member 28 at a location that is forward of the fourth fluid coupling members 92. The control valve is one of a well known variety that contains a plurality of valve spools (not shown) that may be selectively actuated to control the passage of pressurized fluid therethrough. Each valve spool is controlled by an electronically actuated servo that is selectively actuated to direct pressurized fluid to the work implement. One valve spool and servo is normally required for each hydraulic function of the work implement and therefore may vary between work implements.

Figure 2:
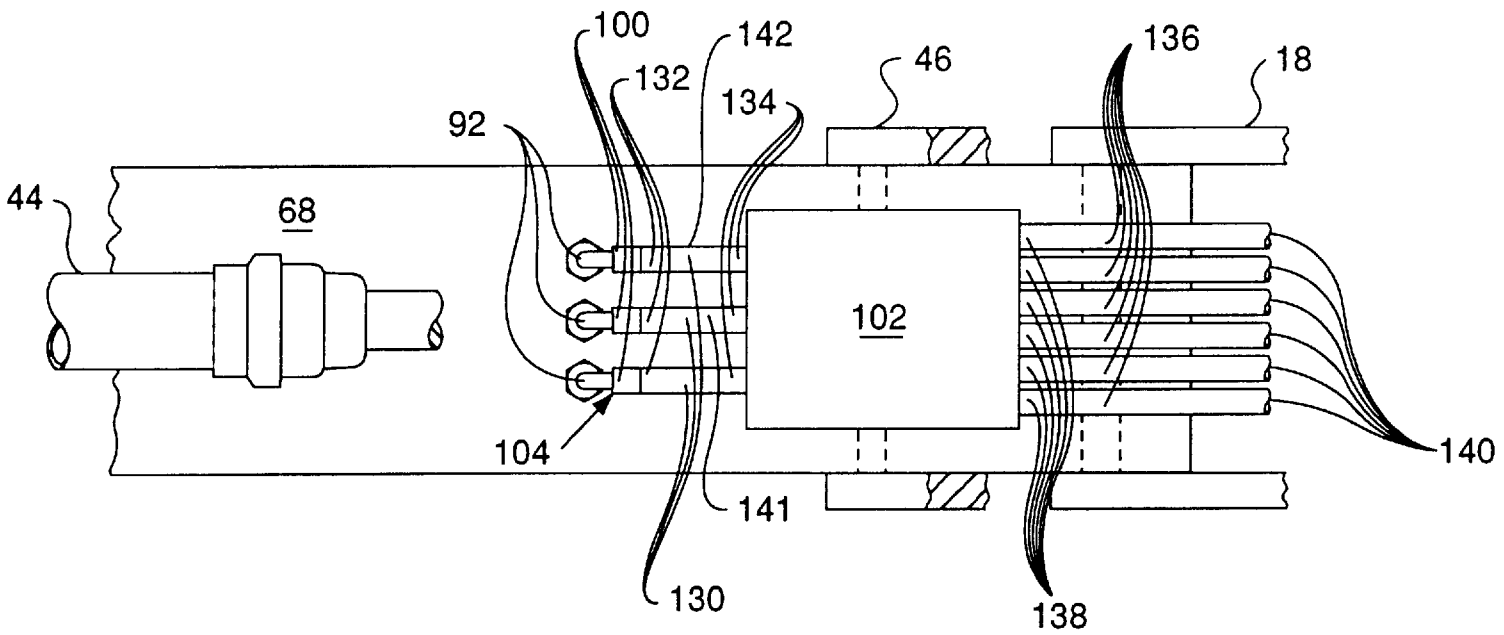
FIG. 2 is a diagrammatic section view taken along lines 2—2 as shown in FIG. 1.

A first fluid conduit means 104 (FIG. 2) is positioned between the engine driven pump located on the main machine frame 12 to the control valve 102 to deliver pressurized fluid to the control valve. The first conduit means includes a first external conduit 106 that has a first end portion connected to the engine driven pump and a second end portion connected to the external connecting portion 82 of one of the first fluid coupling member 78. A first internal conduit segment 112 is positioned within the tubular duct 54 of the internal conduit assembly 50 defined in the boom member 22. The first internal conduit segment 112 has a first end portion 114 connected to the internal connecting portion 80 of the one of the first fluid coupling members 78 and a second end portion 116 that is connected to the internal connecting portion 86 of one of the second fluid coupling members 84. A jumper conduit 118 has a first end portion 120 connecting to the external connecting portion 88 of one of the second fluid coupling members 84 and a second end portion 122 connected to the external connecting portion 96 of one of the third fluid coupling members 90. A second internal conduit segment 124 has a first end portion 126 connected to the internal connecting portion 94 of one of the third fluid coupling members 90 and a second end portion 128 connected to the internal connecting portion 98 of one of the fourth fluid coupling members 92. A second external conduit 130 has a first end portion 132 connected to the external connecting portion 100 of the fourth fluid coupling member 92 and a second end portion 134 connected to a selected port (not shown) on the control valve 102. Finally, an implement conduit 136 has a first end portion 138 connected to an exit port (not shown) defined in the control valve 102 and a second end portion 140 that is connected to a hydraulic actuator (not shown) on the work implement 18.

A second fluid conduit means 141 (FIG. 2) extends between a fluid reservoir, or tank (not shown), that is positioned on the main machine frame 12 and the control valve 102. The second fluid conduit means has components that are identical to that of the first fluid conduit means that extend between the first fluid coupling members 78 and the control valve 102. The components of the second fluid conduit means are positioned immediately adjacent those of the first conduit means, and are essentially identical. The only difference between the first and second fluid conduit means is their origination and termination points and the external conduits that extend from those points. Therefore, for the sake of simplicity, only the components of the first conduit means have been indicated by reference numerals on the drawings. It is to be understood that the reference numerals are applicable to identical components of both fluid conduit means.

An electric wire conduit 142 (FIG. 2) also is positioned to extend between the operator station and the control valve 102 to actuate the servos associated with the respective valve spools. The electric wire conduit is also positioned within the conduit arrangement 48 adjacent the first and second fluid conduit means 104 and 124. The wiring conduit is sufficient for carrying one or more wires necessary for actuating the control valve.

A guard assembly 143 is positioned to bridge the connection between the boom member 22 and the stick member 28. The guard assembly has a first upright 144 that is secured to and extends from the upper plate 57 of the boom member. A second upright 146 is secured to and extends from the upper plate 68 of the stick member. A shield 148 is attached to and extends between each of the first and second uprights to substantially cover the jumper conduits 118 that are positioned therebelow. The shield is made of flexible material such as that utilized on a conveyor belt to accommodate the relative motion between the stick and boom members.

It is to be understood that while only two fluid conduit means are shown and described in the conduit arrangement set forth above, other lines, such as pilot lines or a drain line for the case of the control valve, could easily be incorporated into the conduit arrangement without departing from the principles of the present invention.

Industrial Applicability

In operation of the machine 10, the boom and stick members 22 and 28 respectively are manipulated by an operator positioned within the operator station 16 to move the work implement 18 in a desired manner. In many instances, depending upon what type of implement is being utilized at the time, the work implement will have a plurality of hydraulic functions. Each function will require the delivery of pressurized fluid from the machine frame to the implement positioned on the remote end of the boom and the return of the fluid back to a reservoir mounted on the machine frame. The pressurized fluid is delivered from the engine driven pump to one of the first fluid coupling members 78 through one of the first external conduits 106 that extends therebetween. A first internal conduit segment 112 is positioned within the internal conduit assembly 50 that is integrally formed within the boom member 22. The first internal segment extends between the first fluid coupling member and one of the second fluid coupling members 84 defined on the second end portion 32 of the boom member 22. In a similar manner, the pressurized fluid is delivered through the internal conduit assembly 52 defined in the stick member 28. A second internal conduit segment 124 extends between one of the third and fourth fluid coupling members, 90 and 92 respectively, mounted on opposite ends of the stick member. A second external conduit 130 delivers the pressurized fluid between the fourth fluid coupling member 92 and the control valve 102 mounted on the second end portion of the stick member. A jumper conduit 118 extends between the second and third fluid coupling members, 84 and 90 respectively, to communicate the pressurized fluid between the boom and stick members.

A return line extends between the control valve 102 and a reservoir mounted on the machine frame 12. The return line utilizes essentially identical components to those of the first fluid conduit means 104. The only difference between the first and second fluid conduit means 104 and 141 is that they are positioned adjacent one another as they extend between the machine frame 12 and the control valve 102.

The wiring required to actuate the control valve 102 also extends between the machine frame 12 and the control valve in a conduit means substantially identical to those communicating fluid. The wiring extends from the operator station to one of the first fluid coupling members and from there it is routed to the control valve within the first and second internal conduit assemblies 50 and 52. The wiring permits the electronic control of a plurality of servos positioned within the control valve. Each servo controls fluid flow to each hydraulic actuator on the implement 18 through a pair of second external conduits 130. If the implement has a plurality of hydraulic functions, a pair of lines 130 will extend between the control valve and each actuator. One line will to supply pressure to the actuator and the second line will return fluid to the control vale. Extra lines can be added between the control valve and the work implement, or lines may be removed and appropriate plugs added to the control valve, to accommodate the various requirements of the individual work implements.

Thus it can be seen that a conduit arrangement as set forth above provides several advantages when operating a machine having an implement remotely mounted on the end of a boom assembly. One advantage resides in the protection of the conduits provided by the internal conduit assemblies 50 and 52. Being integrally formed as a part of the structure of the boom members, the conduits are protected for a vast majority of their total extent. An additional advantage is realized with the positioning of the control valve on the distal end portion of the boom assembly 19. By this arrangement, only a minimum number of hydraulic lines and control wires need be routed between the machine and the control valve. The majority of the conduits will extend between the control valve and the implement which is a very short distance when compared to the distance between the machine frame and the control valve. This also makes it much easier to change from one implement to another. Since the conduits are relatively short, a control valve having valve spools for a variety of implements may be utilized, making it very convenient to add or remove extra conduits as needed to operate various implements.

Other aspects, objects and advantages of this invention can be obtained from a study of the drawings, the disclosure and the appended claims.

We claim:

1. A conduit arrangement for communicating pressurized fluid between a machine frame and a work implement remotely mounted to the frame, comprising:

a boom assembly having first and second end portions, said first end portion being pivotally connected to the machine frame and the second end portion mounted to the work implement, said boom assembly being formed from a box section construction having upper, lower and side plates;

at least one first fluid coupling member positioned within one of the upper and lower plates of the boom assembly;

at least one second fluid coupling member positioned within one of the upper and lower plates of the boom assembly;

an internal conduit assembly having a duct secured within the boom assembly between the end portions thereof and at least one fluid conduit positioned within the duct, said conduit having a first end portion connected to an internal portion of the first fluid coupling member and a second end portion connected to an internal portion of the second fluid coupling member;

a first external conduit having a first end portion connected to a source of pressurized fluid and a second end portion connected to an external portion of the first coupling; and a second external conduit having a first end portion connected to an external portion of the second coupling and a second end portion connected to the implement for delivery of the pressurized fluid thereto.

2. The conduit arrangement as set forth in claim 1 wherein the boom assembly further includes:

a first boom member having first and second end portions, said first end portion being pivotally mounted to the machine frame to allow the boom assembly to be moved in a substantially vertical plane with respect to the machine frame: and a second boom member having first and second end portions, said first end portion being pivotally mounted to the second end portion of the first boom member for movement with respect thereto along said vertical plane, and said second end portion being pivotally connected to the work implement for movement with respect thereto along said vertical plane.

3. The conduit arrangement as set forth in claim 2 wherein the first and second boom members have an internal conduit arrangement formed integrally with a plurality of support brackets that are positioned within the confines of the box section.

4. The conduit arrangement as set forth in claim 2 wherein at least one third fluid coupling member is positioned within the upper plate of the first end portion of the second boom member and at least one fourth fluid coupling member is positioned within the upper plate of the second end portion thereof and a fluid conduit is connected therebetween.

5. The conduit arrangement as set forth in claim 4 wherein a jumper conduit is positioned between the first and second boom members for communicating fluid between the internal conduit assemblies, said jumper conduit having a first end portion connected to the second coupling positioned in the first boom member and a second end portion connected to the third fluid coupling member positioned in the second boom member.

6. The conduit arrangement as set forth in claim 2 wherein a control valve is mounted on the second end portion of the second boom member and is positioned for communication with the second end portion of the second external conduit, said control valve being adapted for selectively communicating pressurized fluid between the second external conduit and the work implement through a plurality of conduits that extend between the control valve and the work implement.

7. The conduit arrangement as set forth in claim 6 wherein a high pressure conduit is connected between the source of pressurized fluid a first fluid coupling member on the first boom member and is communicated to the control valve through the respective fluid conduits positioned within the internal conduit assemblies located within the first and second boom members and the jumper conduit connected therebetween.

8. The conduit arrangement as set forth in claim 6 wherein a return conduit is connected between a reservoir of fluid and another first fluid coupling member on the first boom member and is communicated to the control valve through respective fluid conduits positioned within the internal conduit assemblies located within the first and second boom members and a jumper conduit connected therebetween.

9. The conduit arrangement as set forth in claim 6 wherein an electrical wire extends between a control mechanism mounted on the machine frame and the control valve for selectively actuating the control valve and the communication of pressurized fluid to the work implement, said wire being positioned within the internal conduit assemblies of the respective first and second boom members and the jumper conduit that is interconnected therebetween.

10. The conduit arrangement as set forth in claim 6 wherein a guard assembly is positioned between the second end portion of the first boom member and the first end portion of the second boom member in overlying relation to the jumper lines.

11. A conduit arrangement for communicating pressurized fluid from a machine frame to an implement mounted to the frame by a boom assembly, comprising:

a first boom member having first and second end portions, said first end portion being pivotally connected to the machine frame;

a second boom member having first and second end portions, said first end portion being pivotally mounted to the second end portion of the first boom member and the second end portion being pivotally mounted to the work implement;

a control valve mounted on the second end portion of the second boom member;

an internal conduit assembly having a duct defined therein and being secured internally within each of the boom members;

a first fluid conduit means extending between a source of pressurized fluid positioned on the machine frame and the control valve, said first fluid conduit means being positioned substantially within the internal conduit assemblies of the first and second boom members;

a second fluid conduit means extending between a fluid reservoir positioned on the machine frame and the control valve, said second fluid conduit means being positioned substantially within the internal conduit assemblies of the first and second boom members; and a plurality of conduits extending between the control valve and the work implement, each of said conduits being positioned externally of the boom assembly.

12. The conduit arrangement as set forth in claim 11 wherein at least one electric wire extends between a control module positioned on the machine frame and the control valve to permit the selective actuation of the control valve and therefore the selective communication of pressurized fluid between the control valve and the work implement, said electric wire being positioned substantially within the internal conduit assemblies of the first and second boom members.

13. The conduit arrangement as set forth in claim 11 wherein the internal conduit assembly defined by the first boom member further includes:

a pair of first fluid coupling members mounted to the first end portion of the first boom member, each of said first fluid coupling members having an internal connecting portion extending internally of the first boom member and an external connecting portion positioned outside of the boom member;

a pair of second fluid coupling members mounted to the second end portion of the first boom member, each of said second fluid coupling members having an internal connecting portion extending internally of the first boom member and an external connecting portion positioned outside of the boom member;

a first internal conduit segment having a first end portion connected to the internal portion of one of the first fluid coupling members and a second end portion connected to the internal connecting portions of one of the second fluid coupling members; and a second internal conduit segment having a first end portion connected to the internal portion of the other of the first fluid coupling members and a second end portion connected to the internal connecting portions of the other of the second fluid coupling members.

14. The conduit arrangement as set forth in claim 13 wherein the internal conduit assembly defined by the second boom member further includes:

a pair of third fluid coupling members mounted to the first end portion of the second boom member, each of said third fluid coupling members having an internal connecting portion extending internally of the second boom member and an external connecting portion positioned outside of the second boom member;

a pair of fourth fluid coupling members mounted to the second end portion of the second boom member, each of said fourth fluid coupling member having an internal connecting portion extending internally of the second boom member and an external connecting portion positioned outside of the second boom member;

a first internal conduit segment having a first end portion connected to the internal portion of one of the third fluid coupling members and a second end portion connected to the internal connecting portions of one of the fourth fluid coupling members; and a second internal conduit segment having a first end portion connected to the internal portion of the other of the third fluid coupling members and a second end portion connected to the internal connecting portion of the other of the fourth fluid coupling members.

15. The conduit arrangement as set forth in claim 14 wherein a pair of jumper conduits are positioned externally between the first and second boom members, each of said jumper conduits having a first end portion connected to the external connecting portions of the second fluid coupling members and a second end portion connected to the external connecting portions of the third fluid coupling members.

16. The conduit arrangement as set forth in claim 15 wherein a pair of first external conduit segments are positioned between the machine frame and the first boom member, one of said first external conduit segments having a first end portion connected to the source of pressurized fluid and a second end portion connected to an external connecting portion of one of the first fluid coupling members, and the other said first external conduit segment having a first end portion connected to the fluid reservoir and a second end portion connected to the external connecting portions of the other of the first fluid coupling members.

17. The conduit arrangement as set forth in claim 16 wherein a pair of second external conduit segments are positioned between the internal conduit assembly of the second boom member and the control valve, one of said second external conduit segments having a first end portion connected to one of the external connecting portion of one of the fourth fluid coupling members and a second end portion connected to the control valve, and the other of the second external conduit segments having a first end portion connected to the external connecting portion of the other of the fourth fluid coupling members and a second end portion connected to the control valve.

18. A conduit arrangement for communicating pressurized fluid between a machine frame and a work implement remotely mounted to the frame, comprising:

a first boom member having first and second end portions, said first end portion being pivotally connected to the machine frame, said first boom member being formed from a box section construction having upper, lower and side plates;

a second boom member having first and second end portions, said first end portion being pivotally mounted to the second end portion of the first boom member and said second end portion being pivotally connected to the work implement, said second boom member being formed from a box section construction having upper, lower and side plates;

at least one first fluid coupling member positioned within the upper plate of one of the first and second boom members;

at least one second fluid coupling member positioned within the lower plate of one of the first and second boom members;

an internal conduit assembly having a duct secured within the first boom member between the end portions thereof and at least one fluid conduit positioned within the duct, said conduit having a first end portion connected to an internal portion of the first fluid coupling member and a second end portion connected to an internal portion of the second fluid coupling member;

a first external conduit having a first end portion connected to a source of pressurized fluid and a second end portion connected to an external portion of the first coupling; and a second external conduit having a first end portion connected to an external portion of the second coupling and a second end portion connected to the implement for delivery of the pressurized fluid thereto.

* * * * *